United States Patent [19]

Copson

[11] 4,161,947

[45] Jul. 24, 1979

[54] DIVERS EXHAUST VALVE

[76] Inventor: Alexander G. Copson, 52 High St., Yaddlethrope, Scunthorpe, Lincolnshire, England

[21] Appl. No.: 768,459

[22] Filed: Feb. 14, 1977

[30] Foreign Application Priority Data

Feb. 16, 1976 [GB] United Kingdom ..... 6042/76
Feb. 26, 1976 [GB] United Kingdom ..... 7671/76
May 13, 1976 [GB] United Kingdom ..... 19787/76

[51] Int. Cl.[2] ..... B63C 11/18

[52] U.S. Cl. ..... 128/142.3; 137/114; 137/103; 137/DIG. 8; 137/DIG. 9; 137/510; 137/81; 251/61.1

[58] Field of Search ..... 128/142.7, 142.3, 142.2, 128/142 R, 142 G, 146.4, 146.5, 142.5, 147, 145 A; 137/114, 103, 505.12, DIG. 8, DIG. 9, 81 R, 510; 251/61.1

[56] References Cited

U.S. PATENT DOCUMENTS

| | | | |
|---|---|---|---|
| 2,563,665 | 8/1951 | Thomas | 137/510 |
| 2,677,390 | 5/1954 | Davis et al. | 251/61.1 |
| 3,260,278 | 7/1966 | Lund et al. | 137/505.12 X |
| 3,481,333 | 12/1969 | Garrison | 128/142.2 |
| 3,766,933 | 10/1973 | Nicholson, Jr. | 138/DIG. 8 X |
| 3,859,994 | 1/1975 | Almqvist et al. | 128/142.3 |
| 3,924,618 | 12/1975 | Banjavich et al. | 128/142.3 |
| 3,968,794 | 7/1976 | O'Neill | 128/142.7 X |
| 4,037,594 | 7/1977 | Riegel et al. | 128/142.3 |

*Primary Examiner*—Henry J. Recla
*Attorney, Agent, or Firm*—Lawrence Rosen; E. Janet Berry

[57] ABSTRACT

The invention provides an exhaust valve comprising a valve body, an inlet duct in the valve body for receiving gas to be exhausted through the valve, an exhaust duct in the valve body for exhausting the said gas from the valve, and a valve member subject on the one hand to the ambient external pressure and on the other hand to the pressures in the inlet and exhaust ducts, the valve member moving according to changes in the said pressures between an open position in which there is communication between inlet and exhaust ducts for the exhaustion of gas through the valve and a closed position in which it cuts off such communication; the valve member is preferably mounted in a diaphragm. It also provides a similar valve in which the valve member is instead subject on said one hand to a predetermined maintained fluid pressure, e.g. that within a pressurized chamber. The latter valve can be used to control the pressure in an exhaust line from the exhaust valve. One or both valves can be used in a system for recovering for reuse helium employed in breathing mixtures for deep dives.

5 Claims, 9 Drawing Figures

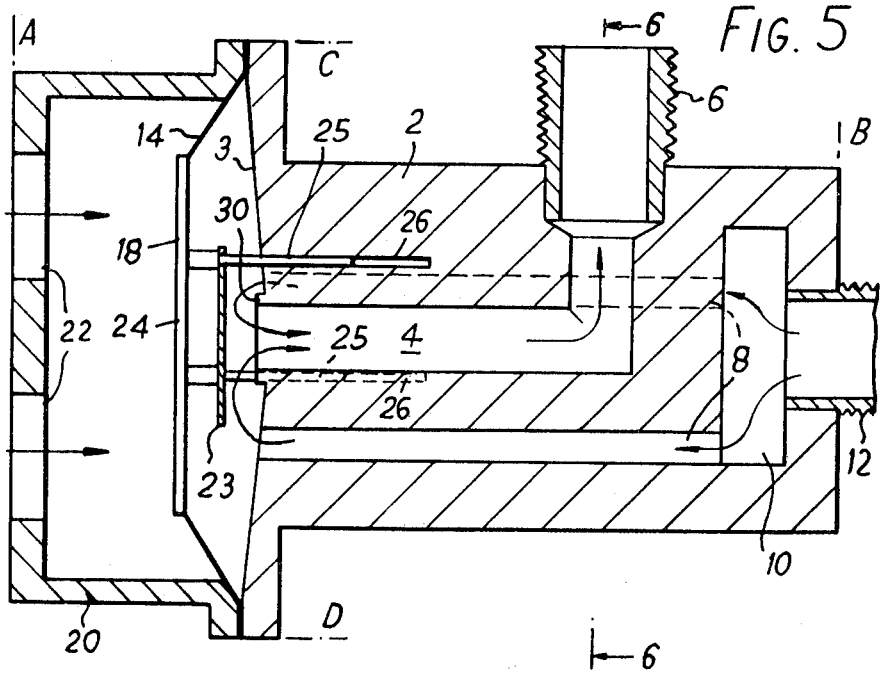
FIG. 5
FIG. 6
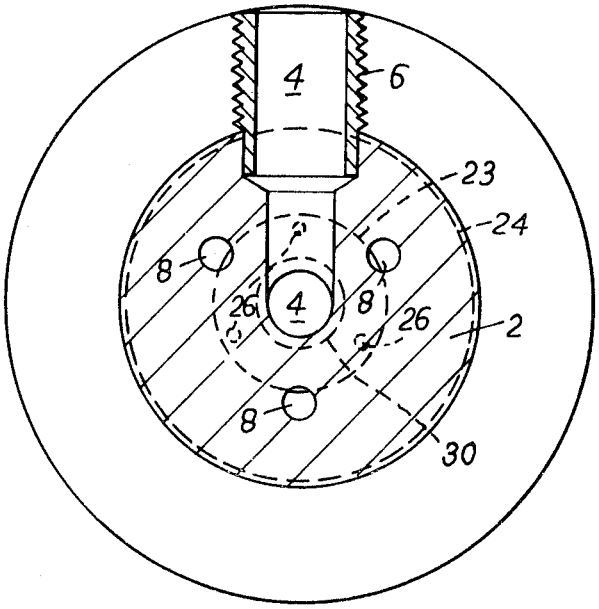

DIVERS EXHAUST VALVE

This invention relates to valves, and provides an exhaust valve for exhausting gases used underwater, e.g. exhalations by a diver, fouled or used gas from a diving bell or submersible vessel or underwater installation, the exhaust valve comprising a valve body, an inlet duct in the valve body for receiving gas to be exhausted through the valve, an exhaust duct in the valve body for exhausting the said gas from the valve, and a valve member subject on the one hand to the ambient external pressure and on the other hand to the pressures in the inlet and exhaust ducts, the valve member moving according to changes in the said pressures between an open position in which there is communication between inlet and exhaust ducts for the exhaustion of gas through the valve and a closed position in which it cuts off such communication.

When, for example, the exhaust valve is in operation in conjunction with a diver's helmet or mask, the inlet duct will communicate with the interior of the diver's helmet or mask and so be at about the same pressure as the external water and the outlet of the exhaust duct can communicate with a line from which the exhaust gases can be collected. With the valve member in the closed position, the pressure in the exhaust duct will be lower than that in the inlet duct, and these pressures and the dimensions of the ducts and valve member will be such that the external ambient pressure (i.e. the water pressure) maintains the valve member in the closed position until sufficient counter-pressure is generated (e.g. by the diver exhaling) to move the valve member temporarily to its open position with consequent exhaustion of the excess (e.g. exhaled) gases via the low pressure exhaust duct; on exhaustion of the gases, the water pressure returns the valve member to its closed position. The exhaust valve will operate correspondingly when used in a corresponding manner for exhaustion of used gas from a bell or other submerged unit, craft or installation.

It will be evident that the principle of the invention, balancing inlet and exhaust line pressure against external water pressure so that exhalation or other build-up of exhaust pressure opens the valve for exhaustion of gases, can be put in operation in a number of ways. The valve body may have a plurality of inlet ducts, and inlet and outlet ducts may be arranged relative to one another in a variety of different ways. The movable valve member is conveniently in diaphragm form, but this is not essential. The arrangement and dimensions of the inlet and exhaust ducts and valve member will be chosen to provide opening of the valve at the appropriate excess inlet duct pressure (over external pressure). In operation the required inlet duct pressure excess can be controlled by a pressure release valve controlling the pressure in the exhaust line. The exhaust valve will of course open to relieve any excess pressure on the inlet side (e.g. in the diver's helmet), whether due to admission of excess fresh gas or to generation of exhaust or exhaled gas.

In a particularly preferred embodiment of the exhaust valve two separate valve members are provided, each subject on the one hand to the ambient external pressure and on the other hand to the pressures in inlet and exhaust ducts, the valve members moving in accordance with changes in the said pressures between the open and closed positions. In this embodiment it can be of practical advantage for one valve member to be more readily openable than the other, due e.g. at least in part to difference in exhaust orifice sizes.

The mentioned pressure release valve, preferably provided in or at the end of an exhaust line communicating with the exhaust duct of the exhaust valve, can be of conventional type but is preferably essentially according to the above definition for the exhaust valve except that the valve member (preferably mounted in a diaphragm) is subject on the one hand not to the ambient external pressure but to a predetermined fluid pressure maintained (e.g. in a closed chamber of which the valve member can form a wall portion) at the value required for the equilibrium pressure in the exhaust line, this predetermined pressure preferably being adjustable; the valve member will thus normally close communication between the release valve inlet duct (communicating with the said exhaust line) and its own outlet or exhaust duct until the exhaust line pressure is increased by exhaustion of gas thereinto from the exhaust valve.

Exhaust valves according to the invention can be used in a diving gas recovery system in which exhaust gas, e.g. from a diver is collected, scrubbed and recompressed for further use. The main interest here is in recovering helium used in helium/oxygen breathing mixtures for deep dives. One such system according to the invention comprises a diver's helmet having an inlet connectable to a supply of pressurised breathing gas mixture and an exhaust valve as defined above for the exhaustion of exhaled gas, the exhaust valve being connectable externally to one end of an exhaust tube; and a recycle module having a pressure release valve (e.g. as described above) having its inlet connectable to another end of such an exhaust tube and its outlet communicating with a tube connectable to a compressor intake, a high pressure tube connectable to the compressor outlet for conveying compressed gas to a high pressure storage bank, and at least one scrubber unit for removing $CO_2$ from the collected gas before and/or after compression. In practice the system will normally be applied to a diver operating from a chamber, e.g. a bell or submersible, and the exhaust tube from the helmet outlet valve will preferably have a first section extending to a manifold in the chamber, and a second section extending from the manifold to the pressure release valve, the bell manifold preferably having a trap for condensed liquids. Provision may also be made for exhausting the chamber atmosphere, when the chamber is depressurized, through the said or another pressure release valve into the low pressure side of the module for scrubbing, recompression, and recycle to store for re-use.

Embodiments of valves according to the invention will now be described by way of example only, with reference to the accompanying drawings, in which:

FIG. 5 is a side elevation view, partly in section, of a fourth valve according to the invention;

FIG. 6 is a section along lines 6—6 of FIG. 5;

In the drawings, like features are indicated by like reference numerals.

Figure 1:
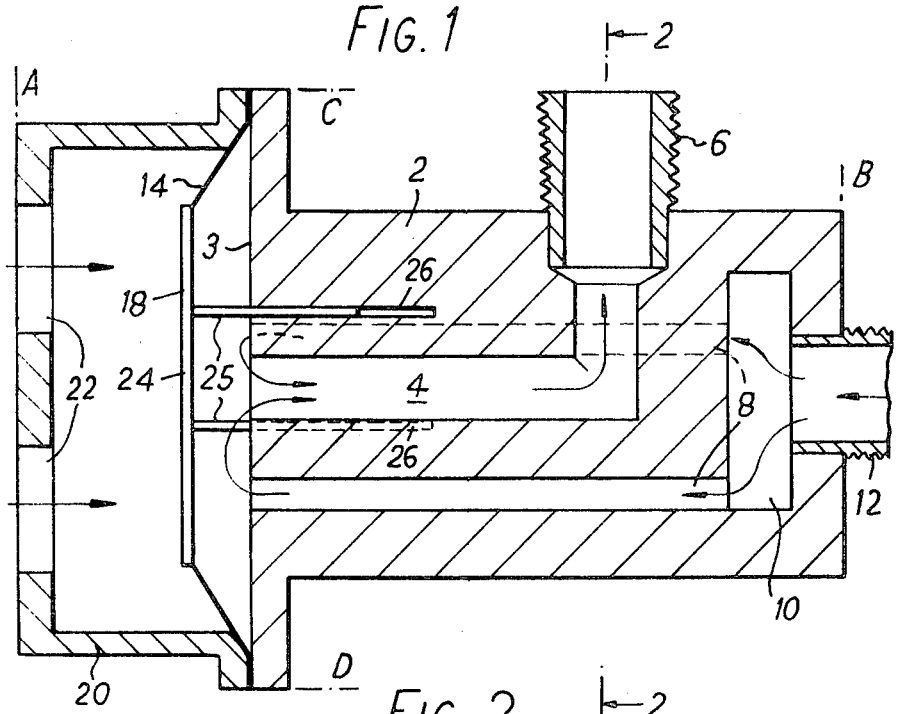
FIG. 1 is a side elevation view, partly in section, of one exhaust valve according to the invention.
Figure 2:
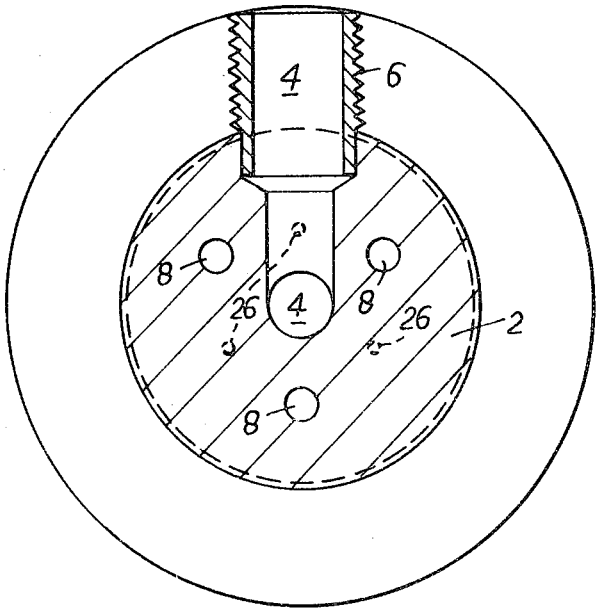
FIG. 2 is a section along the lines 2—2 of FIG. 1.

The valve illustrated in FIGS. 1 and 2 has a valve body 2; an exhaust duct 4 extends axially through the valve body from one face 3 partially towards the other and then radially to its surface. The outlet 6 of the exhaust duct is adapted for connection (e.g. by a screw thread as shown) to a hose (not shown) for exhaust gases. Three inlet ducts 8 are disposed parallel to and symmetrically around the axial part of exhaust duct 4 and extend from the same face 3 of the valve body 2 to a common inlet 10 through the opposite face of the valve body. The projecting portion 12 of the inlet 10 is adapted for connection directly to and through the wall of a diver's helmet (not shown). A diaphragm 14 incorporating a central valve plate or member 18 is secured around its rim between the face 3 of valve body 2 and a protective cap 20; the cap 20 has apertures 22, so that the face 24 of the valve member 18 is exposed to the external ambient pressure, e.g. to the water pressure when in use. The valve plate 18 normally seats over and closes inlet ducts 8 and exhaust duct 4, cutting off communication therebetween. When in use at a given depth, with the inlet communicating with the interior of a diver's helmet and the exhaust duct outlet connected to an exhaust hose, the helmet pressure is maintained at an appropriate breathing pressure and the exhaust duct at a reduced pressure such that the external water pressure will normally maintain the valve plate in this closed seated position, but that increase in the inlet duct pressure (e.g. due to exhalation by the diver) moves the valve plate to an open position as shown in FIG. 1 against the external water pressure until gas has been exhausted via the exhaust duct. Movement of the valve plate 18 can be guided by three pins 25 which slide in bores 26 in the valve body 2, but these are not usually needed and are preferably omitted to leave no parts which move or slide in contact in operation of the valve.

Figure 3:
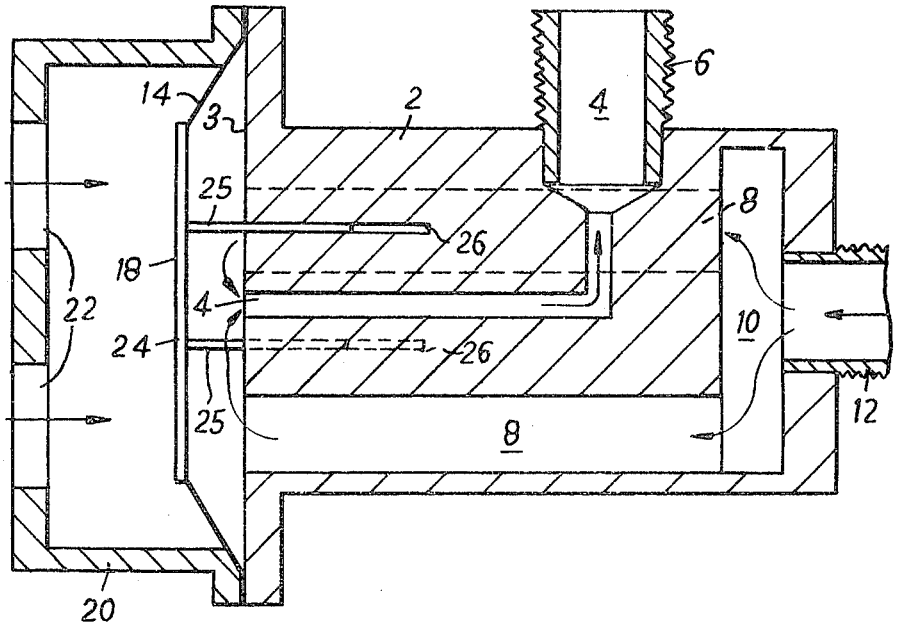
FIG. 3 is a side elevation view, partly in section, of another exhaust valve according to the invention.

The valve shown in FIG. 3 is similar but has wider inlet ducts and a narrower exhaust duct to decrease the inlet duct pressure required, for a given external pressure, to open the valve.

Figure 4:
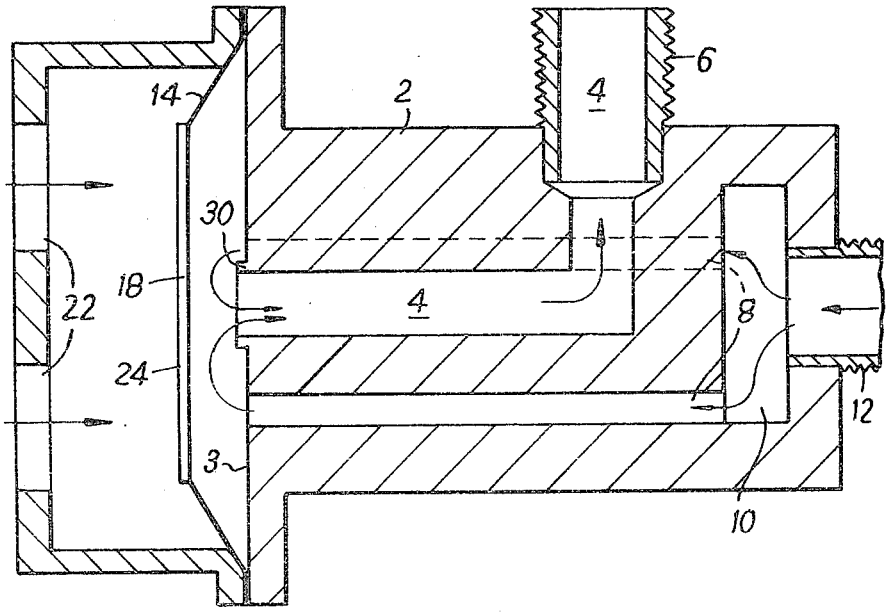
FIG. 4 is a side elevation view, partly in section of a third exhaust valve according to the invention.

The valve of FIG. 4 is also similar, but the valve plate 18 in its closed position seats on valve seat 30 constituted by an extension of duct 4 integral with and projecting from face 3 of the valve body 2. This increases the area of the valve member exposed to the inlet duct pressure and reduces the value of this pressure required to open the valve.

Figure 7:
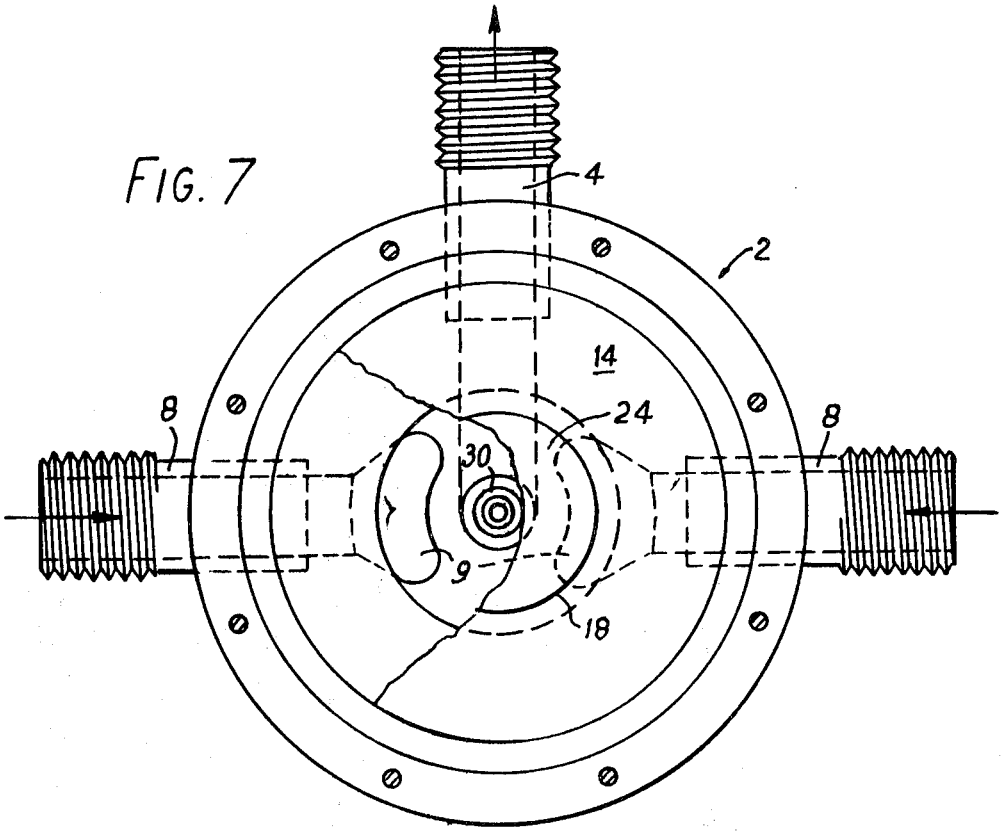
FIG. 7 is a plan view, with parts broken away, of a fifth valve according to the invention.
Figure 8:
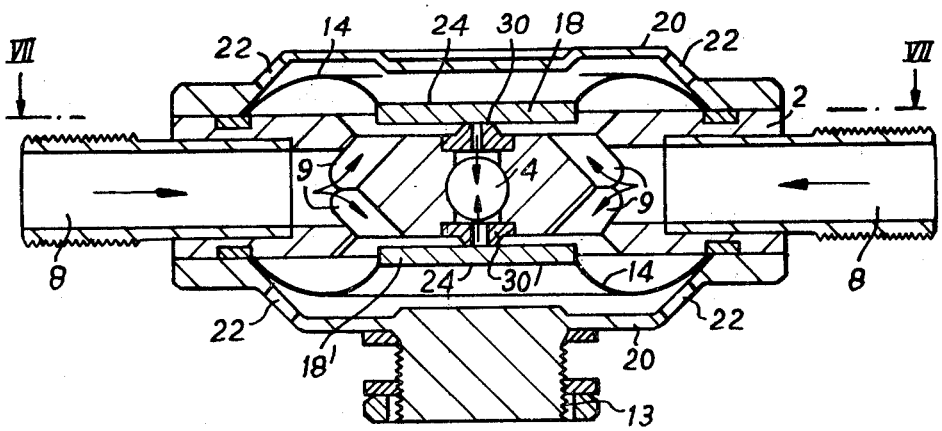
FIG. 8 is a section along lines 8—8 of FIG. 7.

In the valve of FIGS. 5 and 6 face 3 is re-entrant and the pins 25 carry a valve disc or plate 23 which normally seats over valve seat 30 in face 3 to close exhaust duct 4. The pins 25 are in fact not essential and are preferably omitted. Valve disc 23 may instead be mounted on legs extending only from itself to the plate 18; it may for example be formed from a disc with a plurality of radially projecting tabs which are bent at right angles to the disc to form legs which are affixed (e.g. by silver soldering) to the plate 18. FIGS. 7 and 8 show an improved exhaust valve in which a pair of diaphragms 14 with respective central valve plates 18, 18' for seating on respective valve seats 30, 30', control the exhaustion of gas to a common exhaust duct 4. Exhaust gas enters the valve body 2 by inlet ducts 8 and channels 9 and lifts each valve plate 18 from its seat 30 against the ambient water pressure acting on the external face 24 of the valve plate to which the water has access via apertures 22 in each protective cap 20; the gas is thus exhausted via the lower pressure exhaust duct 4 until the water pressure returns the valve plates to close the valve. Valve seat 30 is narrower, e.g. 2 mm internal diameter, than 3', e.g. 5 mm internal diameter, the two halves of the valve being otherwise substantially identical. This is advantageous, member 18 moving most readily from seat 30 on increase in inlet duct pressure and the resulting increase in outlet duct pressure due to the exhaust gas facilitating unseating of member 18'. The valve will be attached, e.g. to a diver's helmet, by screw-threaded boss 13.

The illustrated valves are simple but effective and reliable in operation, and can be machined for the most part from a single block of metal. A distinct advantage of the preferred valves is the absence of moving or mechanical parts which are liable to jam, wear or fail so as to endanger the user; the only moving or mechanical part needed is the diaphragm with its valve member.

Figure 9:
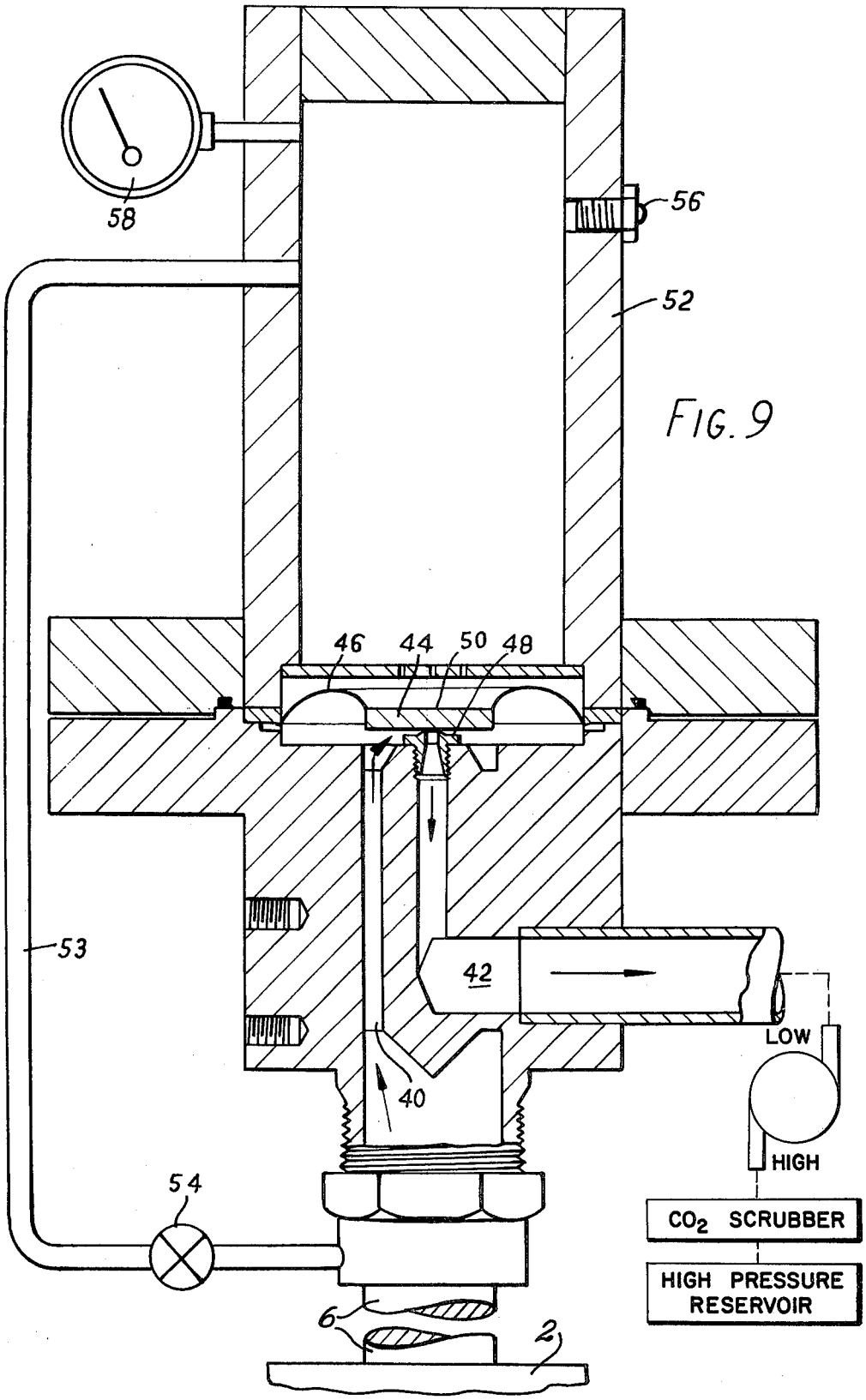
FIG. 9 is an elevation view, in section, of a pressure release valve according to the invention for controlling gas flow from an exhaust line connected to an exhaust valve according to the invention.

FIG. 9 illustrates a valve for an exhaust line, e.g. at the surface, for controlling the exhaust duct pressure and the release of exhaust gas, e.g. to the intake of a compressor. It has an inlet 40 connectable to an exhaust line for communication with the exhaust duct of an exhaust valve according to the invention; outlet 42 may be connected to the intake, low pressure, side of a compressor which compresses the exhaust gas for scrubbing and storage for re-use. Passage of exhaust gas from inlet 40 to outlet 42 is controlled by a valve plate 44 supported in a diaphragm 46 for movement into and out of seating engagement with a valve seat 48. The face 50 of the valve plate is exposed to the fluid pressure maintained in a closed cylinder 52; this predetermined pressure may be selected and adjusted at will. This control valve is thus essentially the same in structure and operation as the exhaust valves except for face 50 being subject to a predetermined, maintained pressure; when the exhaust line pressure exceeds this, on receipt of exhaust or exhaled gas, plate 44 is unseated to allow the release of the exhaust gas. In a preferred operation the whole gas supply and exhaust system, including the exhaust line, is pressurised up to the appropriate working pressure, cylinder 52 being brought to this pressure by opening by-pass 53; valve 54 is then shut to isolate cylinder 52 and needle valve 56 operated to reduce the pressure therein by a required amount, e.g. 1, 2 or 3 bar, as monitored on gauge 58, some gas accordingly exhausts from the exhaust line until the inlet 40 and selected cylinder 52 pressures substantially equalise, and the system is then set ready for use. This preferred control valve can be used with exhaust valves other than those according to the invention.

I claim:

1. A normally closed exhaust valve for divers' breathing apparatus comprising:

a valve body;

a chamber defined at least in part by said valve body;

at least one inlet duct in said valve body including means for receiving gas to be exhausted from said diver's breathing apparatus, each said inlet duct being in communication at one end thereof with said chamber;

at least one exhaust duct in said valve body for selectively receiving gas from said inlet ducts and for exhausting the gas, each said exhaust duct terminating at one end thereof in an orifice opening into said chamber;

at least one diaphragm forming a wall portion of said chamber and each carrying a valve member thereon positioned adjacent each said exhaust duct orifice, each said valve member being normally urged into seating position relative to each said exhaust duct orifice to thereby prevent communication between the inlet and exhaust ducts, said diaphragm being exposed on the side thereof remote from its associated chamber solely to ambient external pressure and on the other side thereof solely to the combined pressure in said chamber and said exhaust duct;

pressure control means connected to said exhaust duct for maintaining a predetermined pressure therein;

a compressor having a low pressure inlet and a high pressure outlet;

a high pressure gas reservoir;

conduit means connected between said exhaust duct and an inlet of said pressure control means, between an outlet of said pressure control means and the inlet of said compressor and between the outlet of said compressor and said reservoir;

and a carbon dioxide scrubber unit connected between said pressure control means and said reservoir;

whereby each said valve member is movable in accordance with changes in the pressure acting on the opposed sides of said diaphragm between a first normally closed position in which its seats on the orifice at said one end of said exhaust duct to prevent communication between the inlet and exhaust ducts and a second open position in which the valve member is unseated from the said orifice and is spaced from same to permit communication between said inlet and exhaust ducts for exhaustion of gas from the valve.

2. An exhaust valve according to claim 1, wherein said pressure control means comprises a second valve body including a second chamber defined at least in part by said second valve body, a pressurized container connected to said second valve body, at least one inlet duct in said second valve body connected to and for receiving gas exhausted from the exhaust duct of the first mentioned valve body, each said inlet terminating at one end thereof in said second chamber, an exhaust duct in said second valve body for selectively receiving gas from the inlet ducts of said second valve body and for exhausting the gas, the exhaust duct in said second valve body terminating at one end thereof in an orifice opening into said second chamber, and a diaphragm carrying a valve member thereon forming a wall portion of said second chamber and separating said pressurized container from said second chamber, said diaphragm being exposed on the side thereof remote from said second chamber to the pressure maintained in said pressurized container and on the other side thereof to the combined pressures within the inlet and exhaust ducts of said second valve body, said valve member being normally urged into seating position relative to the exhaust duct orifice in said second valve body to thereby prevent communication between the inlet and exhaust ducts of said second valve body, and whereby the valve member in said second chamber is movable in accordance with changes in the pressure acting on the opposed sides of the diaphragm carrying same between a first normally closed position in which it seats on the orifice opening into said second chamber to prevent communication between the inlet and exhaust ducts of said second valve body and a second position in which the valve member is unseated from the said orifice and is spaced from same permitting communication between the inlet and exhaust ducts for the exhaust of the gas from said second valve body.

3. A normally closed exhaust valve for divers' breathing apparatus comprising:

a valve body;

a chamber defined at least in part by said valve body;

at least one inlet duct in said valve body including means for receiving gas to be exhausted from said diver's breathing apparatus, each said inlet duct terminating at one end thereof in said chamber;

at least one exhaust duct in said valve body for selectively receiving gas from said inlet ducts and for exhausting the gas, each said exhaust duct terminating at one end thereof in an orifice opening into said chamber;

at least one diaphragm forming a wall portion of said chamber and each carrying a valve member thereon positioned adjacent each said exhaust duct orifice, each said valve member being normally urged into seating position relative to an exhaust duct orifice to thereby prevent communication between the inlet and exhaust ducts, said diaphragm being exposed on the side thereof remote from said chamber solely to ambient external pressure and on the other side thereof solely to the combined pressures in said chamber and said exhaust duct;

whereby each said valve member is movable in accordance with changes in the pressure acting on the opposed sides of said diaphragm between a first normally closed position in which it seats on the orifice at said end of said exhaust duct to prevent communication between the inlet and exhaust ducts and a second open position in which the valve member is unseated and is spaced from said exhaust duct orifice permitting communication between said inlet and exhaust ducts for the exhaustion of the gas through the valve, and means for maintaining a predetermined pressure in said exhaust duct, said pressure-maintaining means comprising a second valve body including a second chamber defined at least in part by said second valve body, a pressurized container connected to said second valve body, at least one inlet duct in said second valve body connected to and for receiving gas exhausted from the exhaust duct of the first mentioned valve body, each said inlet duct terminating at one end thereof in said second chamber, an exhaust duct in said second valve body for selectively receiving gas from the inlet ducts of said second valve body and for exhausting the gas, the exhaust duct in said second valve body terminating at one end thereof in an orifice opening into said second chamber, and a diaphragm carrying a valve member thereon positioned adjacent said exhaust duct orifice and forming a wall portion of said second chamber and separating said pressurized container from said second chamber, said diaphragm being exposed on the side thereof remote from said second chamber solely to the pressure maintained in said pressurized container and on the other side thereof to the combined pressure within the inlet and exhaust ducts of said second valve body, said valve member being normally urged into seating position relative to the exhaust duct orifice in said second valve body to thereby prevent communication between the inlet and exhaust ducts of said second valve body, and whereby the valve member is movable in accordance with changes in the pressure acting on the opposed sides of the diaphragm carrying same between a first normally closed position in which it seats on the orifice opening into said second chamber to prevent communication between the inlet and exhaust ducts of said second valve body and a second position in which the valve member is unseated and is spaced from the exhaust duct orifice permitting communication between the inlet and exhaust ducts for the exhaustion of the gas from said second valve body.

4. An exhaust valve according to claim 3, including conduit means directly connecting the inlet duct of said second valve body with said pressurized container and valve means in said conduit for regulating the pressurized fluid therein.

5. A normally closed exhaust valve for divers' breathing apparatus comprising:

a valve body;

a pair of chambers each of which is defined at least in part by said valve body;

at least one inlet duct in said valve body including means for receiving gas to be exhausted from said diver's breathing apparatus, each said inlet duct being in communication with at least one of said chambers;

a common exhaust duct in said valve body and a pair of exhaust duct orifices communicating therewith and selectively with respective ones of said chambers for conducting gas from said chambers to said common exhaust duct, the cross-sectional areas of said exhaust duct orifices being different from each other to thereby effectuate sequential opening of the said orifices by the lifting of valve members therefrom which are normally urged into seated relationship on said exhaust duct orifices;

a pair of diaphragms each carrying a valve member positioned adjacently and seatable on one of said exhaust duct orifices and each diaphragm forming a wall portion of a different one of said chambers, each of said diaphragms being exposed on one side thereof remote from its associated chamber solely to ambient external pressure and at the other side thereof solely to the combined pressure in said associated chamber and said exhaust duct;

whereby each said valve member is movable relative to its associated exhaust duct orifice in accordance with changes in the pressure acting upon the opposed sides of the diaphragm carrying same between a first normally closed position in which it is seated on its associated orifice to prevent communication between the inlet duct for the chamber and said exhaust duct orifice and a second open position in which the valve member is unseated from the said orifice and is spaced from same to permit communication between the inlet duct and the exhaust duct orifice for exhaustion of gas from the valve.

* * * * *